US010166576B2

(12) United States Patent
Antoun

(10) Patent No.: US 10,166,576 B2
(45) Date of Patent: Jan. 1, 2019

(54) SYSTEMS AND METHOD FOR MAINTAINING A LIQUID FREE OF PARTICLES

(71) Applicant: Gregory S. Antoun, Meadville, PA (US)

(72) Inventor: Gregory S. Antoun, Meadville, PA (US)

( * ) Notice: Subject to any disclaimer, the term of this patent is extended or adjusted under 35 U.S.C. 154(b) by 1194 days.

(21) Appl. No.: 13/887,993

(22) Filed: May 6, 2013

(65) Prior Publication Data

US 2014/0326326 A1 Nov. 6, 2014

(51) Int. Cl.
*B08B 3/02* (2006.01)
*B08B 3/14* (2006.01)

(52) U.S. Cl.
CPC ..... *B08B 3/14* (2013.01); *Y10T 137/0402* (2015.04); *Y10T 137/4238* (2015.04)

(58) Field of Classification Search
CPC ..... Y10T 137/4238; Y10T 137/0402; B08B 3/14
See application file for complete search history.

(56) References Cited

U.S. PATENT DOCUMENTS 4,895,647 A * 1/1990 Uchiyama ..... B01D 33/073 209/223.1
4,992,167 A * 2/1991 Uchiyama ..... B01D 33/073 210/171
5,167,839 A * 12/1992 Widmer, II ..... B01D 21/2455 198/716
5,297,657 A * 3/1994 McConkey ..... B23Q 11/1076 184/27.1
5,494,134 A * 2/1996 McConkey ..... B23Q 11/1038 184/27.1
5,849,183 A * 12/1998 Ota ..... B01D 33/073 198/716
5,992,642 A * 11/1999 Ota ..... B01D 33/04 210/394

FOREIGN PATENT DOCUMENTS

JP 08126935 A * 5/1996

* cited by examiner

*Primary Examiner* — Alexander Markoff
(74) *Attorney, Agent, or Firm* — Bartony & Associates, LLC

(57) ABSTRACT

A system includes a high-pressure liquid supply system including a valve to relieve pressure upon a state change, at least one nozzle in fluid connection with the valve, and at least one filter element, the nozzle at least one being adapted to spray the filter element with high-pressure liquid upon actuation of the valve upon a state change. The high-pressure liquid supply system may, for example, be a high-pressure coolant system for use with a machine tool, and the at least one nozzle may, for example, be adapted to spray the at least one filter element to remove metal particles therefrom.

17 Claims, 8 Drawing Sheets

Fig. 1B
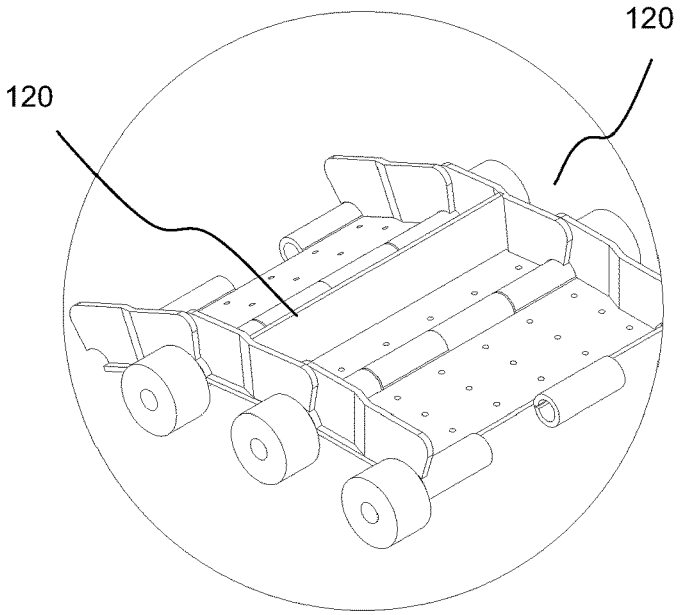
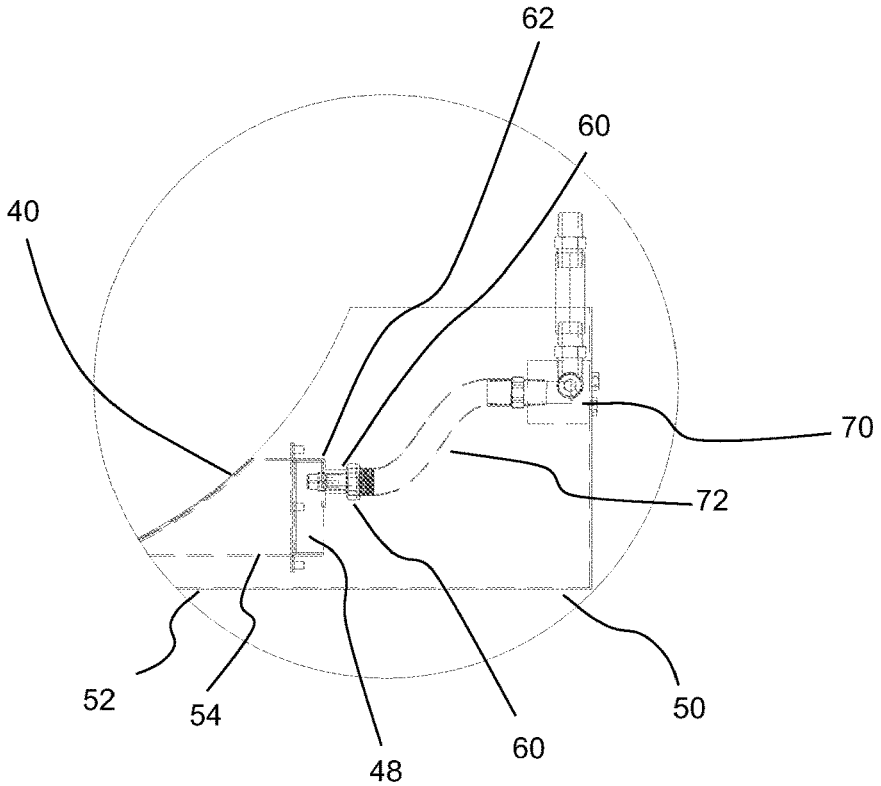
Fig. 1C

Fig. 3A
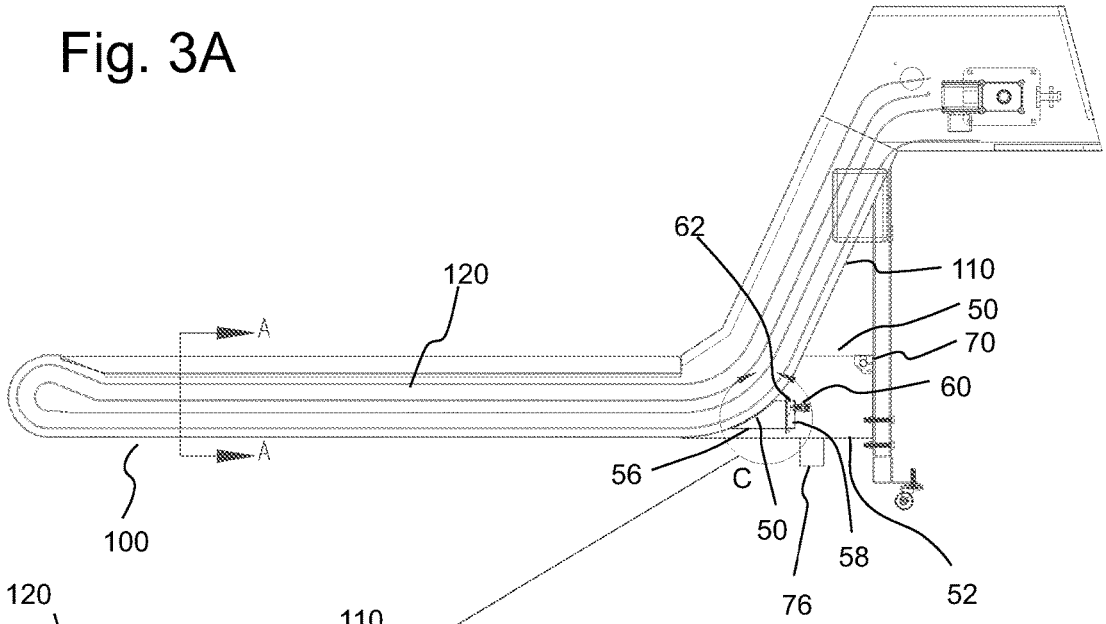
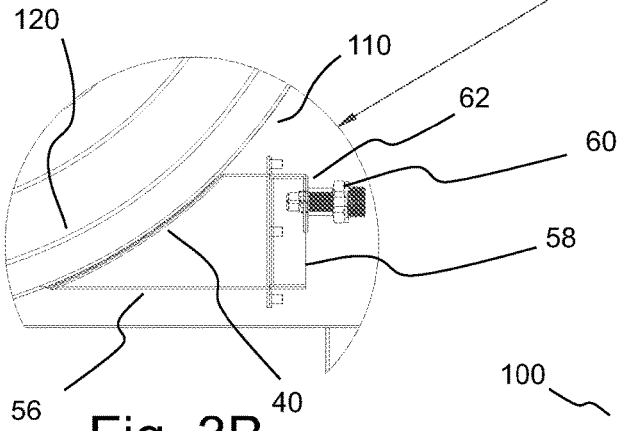
Fig. 3B
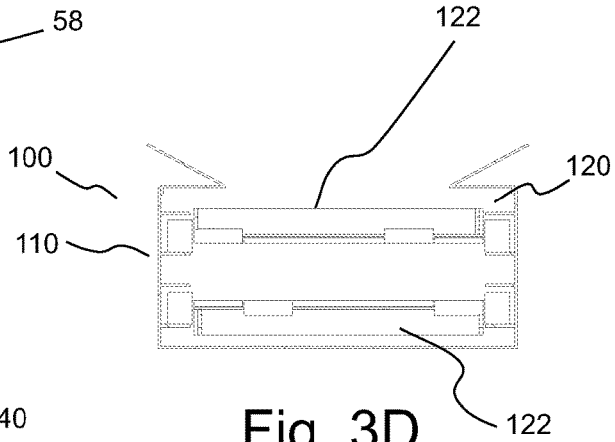
Fig. 3D
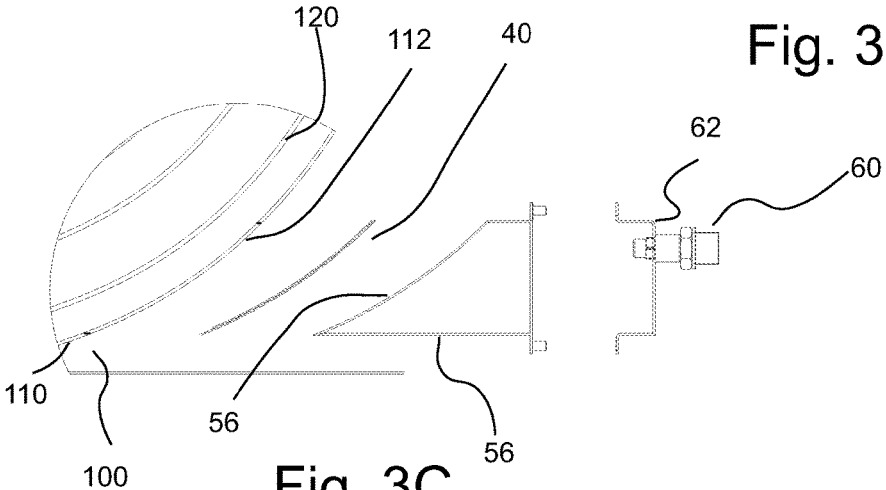
Fig. 3C

SYSTEMS AND METHOD FOR MAINTAINING A LIQUID FREE OF PARTICLES

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

The use a coolant or cutting oil (combined as "coolant" in body) in metal cutting increases the efficiency of the cutting tool. Unfortunately the coolant is contaminated with metallic particulate during the cutting process. The coolant is most often pumped in a closed loop through the machine tool, onto the tool/part. The coolant then flows back into the metal cutting machine's sump. To prevent damage to the part, the tool and the metal cutting machine, these particles should be removed before the coolant is pumped back through the metal cutting machine. In the past, it has been difficult, time consuming and/or expensive to remove these particulates from the coolant. The most common filtration system in a metal cutting machine is a very coarse (3000 micron) removable baffle with relatively large holes that catch only the large metal shavings. These perforated baffles require frequent manual cleaning that cause machine downtime. When these perforated baffles are removed for frequent cleaning, dirty coolant and metal waste freely flows from the "dirty side" of the coolant tank to the "clean side". This system is so inefficient that the "clean side" often fills up with inches of abrasive metal waste that damages the internal components of the metal cutting machine. The thick layer of metal waste is also a medium for anaerobic bacteria that are the main reason for coolant degradation and high replacement costs. This high level of anaerobic bacteria can also cause operator dermatitis that in some cases cause lost work and even disability.

In a number of systems, there are rotating drum conveyers that clean coolant in a conveyer system operatively connected to the machine tool, but they operate at very low pressure (15-20 psi.) and are large, mechanically complex and inefficient. These drum filters are so large that they cannot be used in the majority of metal cutting machines.

High-pressure coolant (for example, at approximately 1000 psi.) has become increasingly popular as a way to improve metal cutting efficiency. The high-pressure coolant is typically plumbed to the metal cutting machine through a hydraulic manifold with at least one outlet to the metal cutting machine and one outlet that is typically referred to as the "dump" that goes to atmosphere in a high-pressure coolant tank or a metal cutting machine tank. Such an arrangement is required so that the coolant flow can be stopped whenever the metal cutting machine changes state. These changes of state include, for example, any tool change, part change or simply turning the metal cutting machine off currently, at each of these changes of state, the valve that is open to the metal cutting machine typically closes very quickly (for example, in approximately 80-100 milliseconds) to prevent damage to the metal cutting machine's internal components. A "dump" valve of the high-pressure coolant system opens just as quickly and at the same time to harmlessly divert all of the residual pressure and coolant volume to the high-pressure coolant system tank or the machine tool sump/tank.

A high-pressure coolant system typically includes a positive displacement pump powered by a 3 phase motor. When the valve that supplies the metal cutting machine with coolant quickly closes in 80 milliseconds, it takes a few seconds for the energy of the rotating mass of the pump parts, the motor and the pressurized coolant to dissipate as waste energy through the dump valve into the sump or tank.

SUMMARY

In one aspect, a system includes a high-pressure liquid supply system including a valve to relieve pressure upon a state change, at least one nozzle in fluid connection with the valve, and at least one filter element, the nozzle at least one being adapted to spray the filter element with high-pressure liquid upon actuation of the valve upon a state change. The high-pressure liquid supply system may, for example, be a high-pressure coolant system for use with a machine tool, and the at least one nozzle may, for example, be adapted to spray the at least one filter element to remove metal particles therefrom.

In a number of embodiments, the system further includes a conveyor system adapted to be placed in operative connection with the machine tool to convey metal particles from the machine tool to a collection volume. The conveyor system may, for example, be placed in fluid connection with a first tank section for collecting coolant supplied to the machine tool and metal particles. The at least one filter element may, for example, separate the first tank section from a second tank section for the coolant. The second tank section may, for example, be in fluid connection with the high-pressure coolant system. The filter element may, for example, be placed in connection with an opening in a housing of the conveyor system.

In a number of embodiments, the at least one filter element is a screen. The screen may, for example, be adapted to prevent particles of a size no greater than 500 microns from passing therethrough, to prevent particles of a size no greater than 250 microns from passing therethrough, or to prevent particles of a size no greater than 100 microns from passing therethrough.

In a number of embodiments, the conveyor comprises a plurality of wipers to collect metal particles removed from the screen via spray from the nozzle. The wipers may for example, be positions upon a conveyor track or conveyor belt of the conveyor system.

In another aspect, a method includes spraying at least one filter element with a high-pressure liquid spray from a nozzle. The nozzle is connected to valve of a high-pressure liquid supply system. The valve is adapted to relieve pressure upon a state change, such that the valve is actuated upon a state change to supply high pressure liquid to the nozzle. The high-pressure liquid supply system may, for example, be a high-pressure coolant system for use with a machine tool, and the at least one nozzle may, for example, be adapted to spray the at least one filter element to remove metal particles therefrom. In a number of embodiments, the filter element is a screen in fluid connection with a conveyor system adapted to be placed in operative connection with the machine tool to convey metal particles from the machine tool to a collection volume. The conveyor system may, for example, be placed in fluid connection with a first tank section for collecting coolant supplied to the machine tool and metal particles.

In a further aspect, a system includes a high-pressure coolant system including a valve to relieve pressure upon a state change, a machine tool in fluid connection with the high pressure coolant system, a first tank section for collecting coolant supplied to the machine tool from the high-pressure coolant system and metal particles, a conveyor adapted to be place in operative connection with the machine tool to convey metal particles from the machine tool to a collection volume, the conveyor being placed in fluid connection with the first tank section, a second tank section in fluid connection with the high-pressure coolant system, at least one filter element separating the first tank section from a second tank section; and at least one nozzle in fluid connection with the valve wherein the nozzle sprays the filter element with high-pressure liquid upon actuation of the valve upon a state change.

In a number of embodiments, the filter element is placed in connection with an opening in a housing of the conveyor system. The filter element may, for example, be a screen. The screen may, for example, be adapted to prevent particles of a size no greater than 500 microns from passing therethrough, to prevent particles of a size no greater than 250 microns from passing therethrough, or to prevent particles of a size no greater than 100 microns from passing therethrough.

In a number of embodiments, the conveyor comprises a plurality of wipers to collect metal particles removed from the screen via spray from the nozzle. The wipers may for example, be positions upon a conveyor track or conveyor belt of the conveyor system.

The present devices, systems, and methods, along with the attributes and attendant advantages thereof, will best be appreciated and understood in view of the following detailed description taken in conjunction with the accompanying drawings.

BRIEF DESCRIPTION OF THE DRAWINGS

FIG. 1B illustrates an enlarged perspective view of portion A of FIG. 1A.

FIG. 1C illustrates an enlarged hidden line or transparent view of portion B of FIG. 1A.

FIG. 3A illustrates another side cutaway view of the conveyor system and filter media cleaning system of FIG. 1A.

FIG. 3B illustrates an enlarged view of portion C of FIG. 3A.

FIG. 3C illustrates an exploded or disassembled view of the portion of FIG. 3B.

FIG. 3D illustrates view cutaway view along section A-A of the conveyor system of FIG. 1A.

DETAILED DESCRIPTION

Figure 1A:
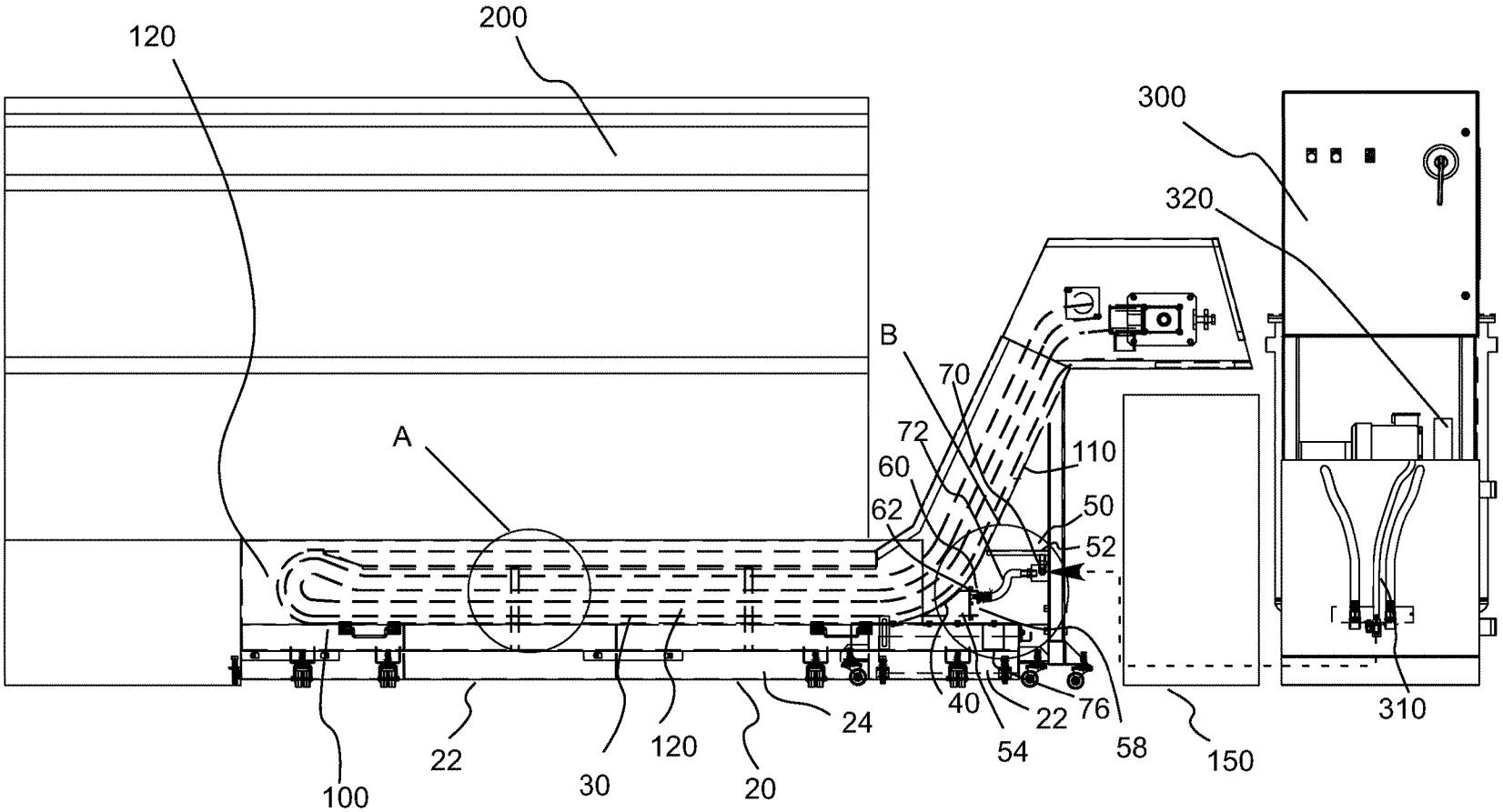
FIG. 1A illustrates a side, partially hidden line or transparent view of an embodiment of a system hereof.
Figure 2:
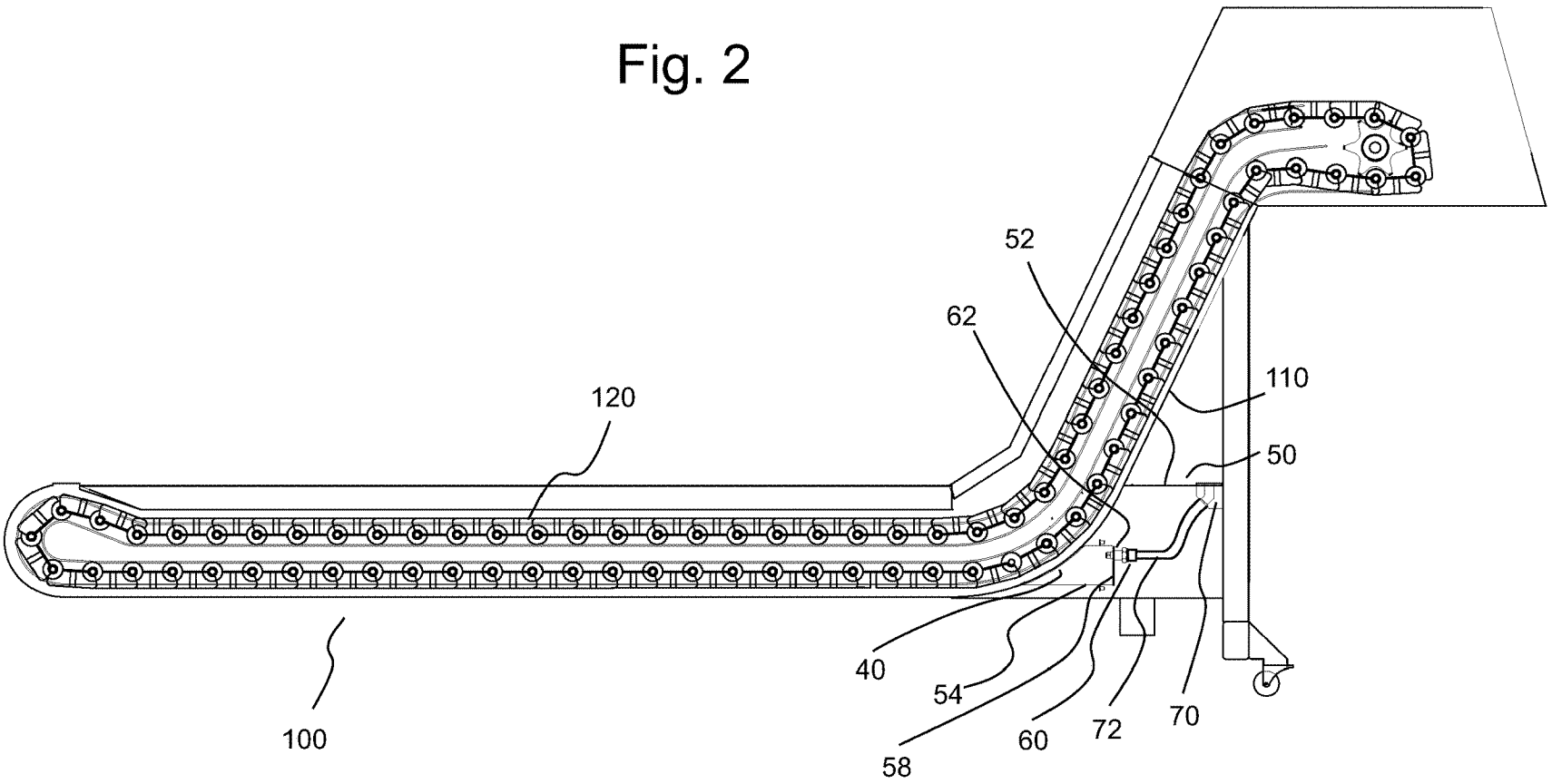
FIG. 2 illustrates a side cutaway view of the conveyor system and the filter media cleaning system of FIG. 1A.
Figure 4A:
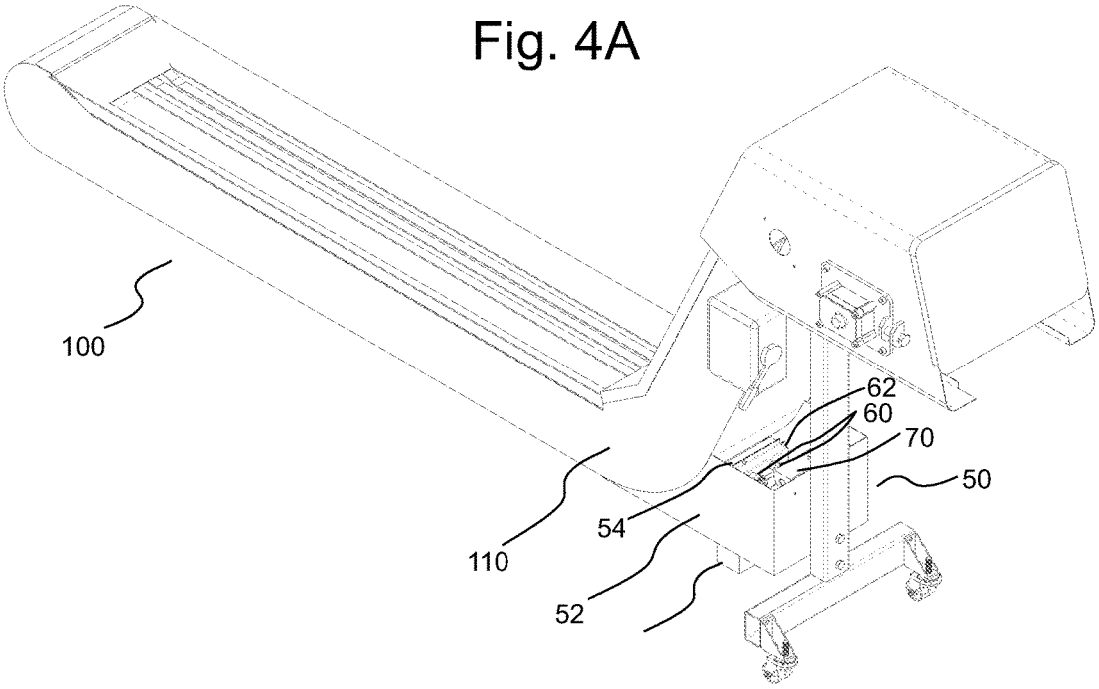
FIG. 4 illustrates a perspective view of the conveyor system and filter media cleaning system of FIG. 1A, wherein a top section of the filter media cleaning system housing has been removed.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "a screen" includes a plurality of such screens and equivalents thereof known to those skilled in the art, and so forth, and reference to "the screen" is a reference to one or more such screens and equivalents thereof known to those skilled in the art, and so forth.

In a number of representative embodiments of a system 5 hereof, previously wasted energy from a high-pressure system such as a high-pressure coolant system is used to clean one or more filter media, filter media elements, filter elements or systems. In a number of embodiments, waste energy from a high-pressure coolant system is plumbed to a metal cutting machine tank or conveyer to clean the conveyer's filter media (for example, one or more screens or meshes) at high pressure.

In a representative embodiment, a chip (metal particle) conveyer system 100 with a collection tank 20 in fluid connection therewith is, for example, placed inside a metal cutting machine 200 so that the coolant and metal waste from metal cutting machine 200 fall on to the conveyer's metal belt 30.

Figure 5:
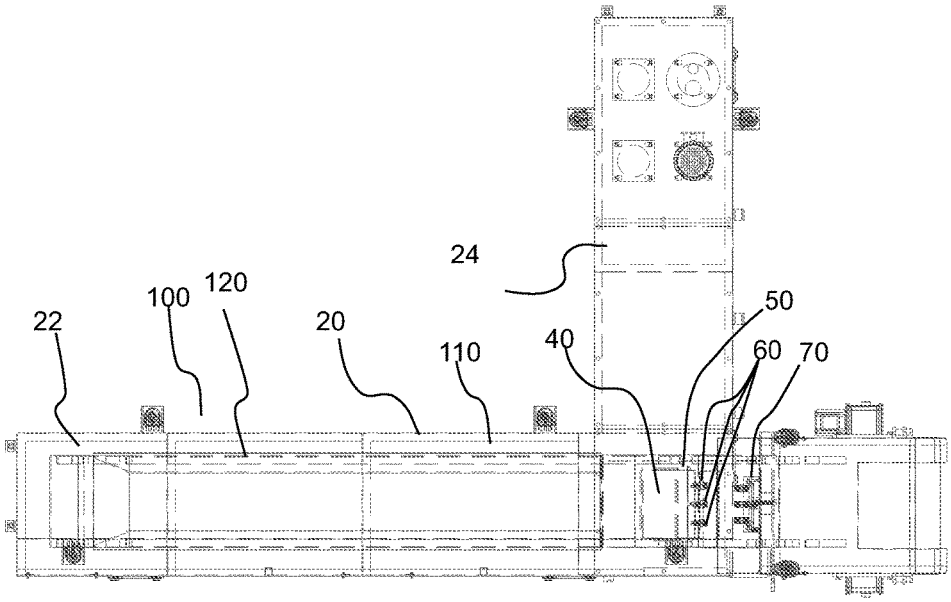
FIG. 5 illustrates a top, partially hidden line or transparent view of the system of FIG. 1A.
Figure 6:
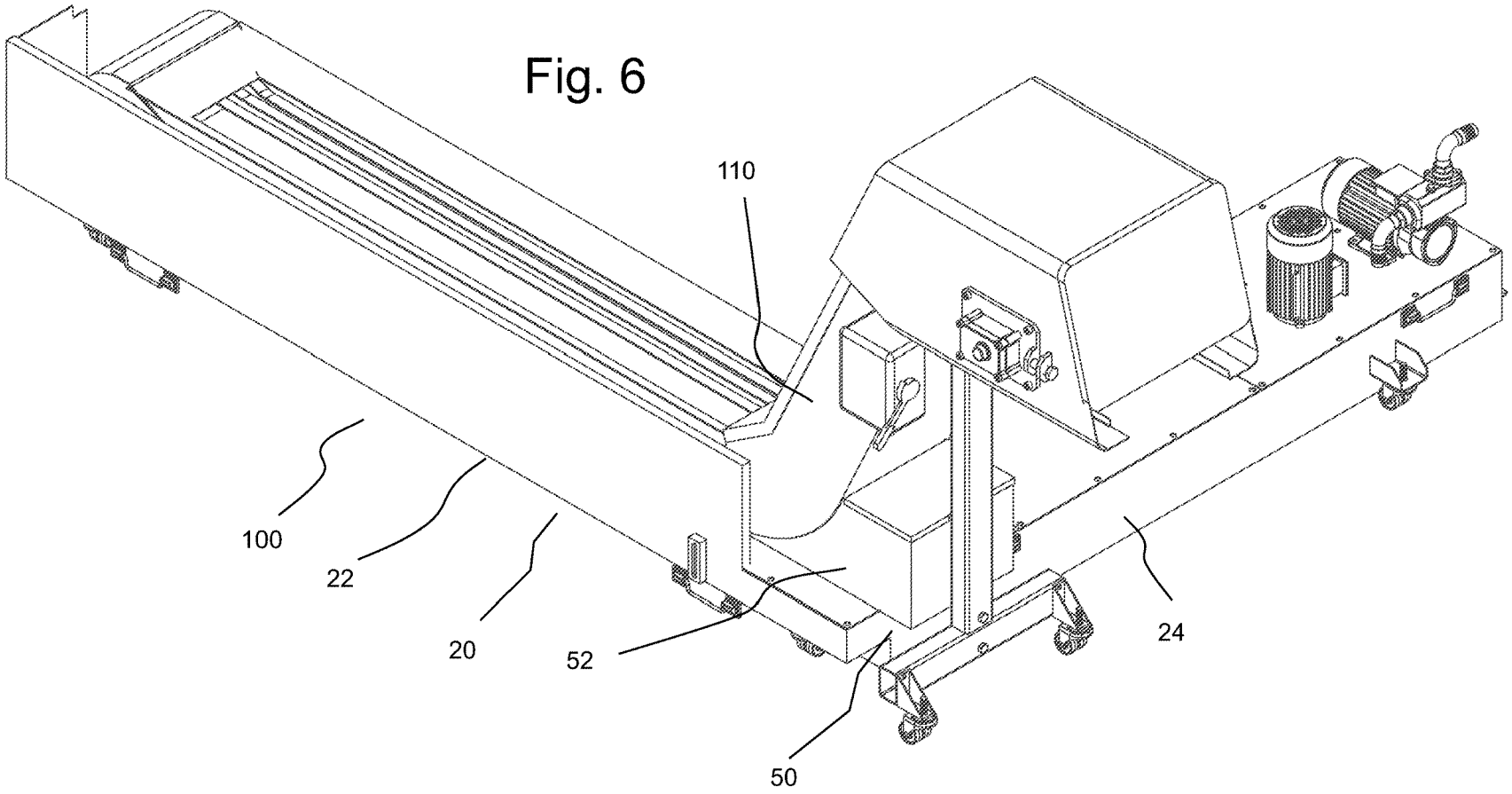
FIG. 6 illustrates a perspective view of the conveyor system, the tank and the filter media cleaning system of FIG. 1A.

In the illustrated embodiment, a portion of a conveyor track or belt 120 of conveyer system 100 sits in a portion or section of a tank 20 that has not been filtered and is sometimes referred to herein as the first section or "dirty side" 22 of tank 20. In currently available systems, a very coarse (for example, 3000 micron), removable perforated metal screen has been used to separate the first section or dirty side of a tank from a second section or clean side of a tank. In the illustrated embodiment, tank 20 is L-shaped (see, for example, FIG. 5). First section 22 is separated from second section 24 by one or more filter elements such as a screen 40. Typically "filter media", "filter medial elements", "filter elements" or like terms used in the systems hereof are device that separate solid particles from a liquid on the basis of size exclusion and include, for example, meshes, screens and or other size exclusion systems.

Unlike the very coarse metal screens used as filter elements in currently available systems, screen 40 may be much finer (that is, suitable to separate much finer particles from the liquid in which such particles are present). In a number of embodiments, the openings, passages or pathways in the filter element or screen are of a size to separate particles of a size no greater than 2000 microns, no greater than 1000 microns, no greater than 500 microns, no greater than 250 microns or even no greater than 100 microns. In a number of embodiments, a 50 to 100 micron screen 40 was used in systems hereof. Screen 40 may, for example, be mounted over an arced opening 112 in conveyor system housing 110 that is in fluid connection with tank section 22 via, for example, filter screen holders (not shown) positioned on lateral each side of screen 40 so that a first side of filter screen 40 is in fluid connection with first section 22 of tank 20 (see, for example, FIG. 3C). In a number of embodiments, conveyer 100 is designed to optimize the position of the filter screen(s) 40.

Figure 7A:
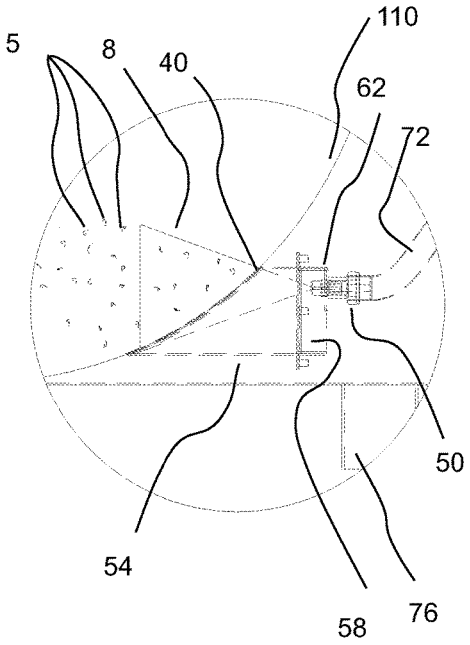
FIG. 7A illustrates a side, partially cross-sectional view of a filter media cleaning system of the system of FIG. 1A in connection with the conveyor system.
Figure 7B:
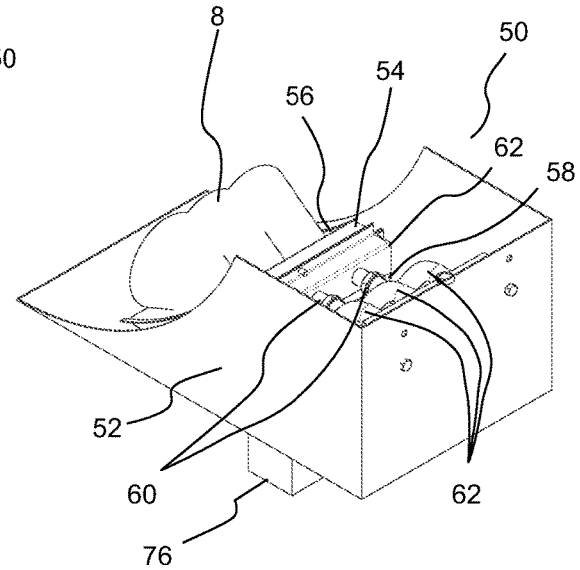
FIG. 7B illustrates a perspective view of the filter media cleaning system wherein a top section of the housing therefor has been removed.
Figure 7C:
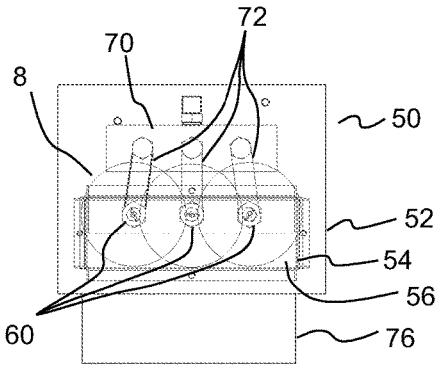
FIG. 7C illustrates a front view of the filter media cleaning system, illustrating the nozzles thereof, and showing spray jets from nozzles thereof.
Figure 7D:
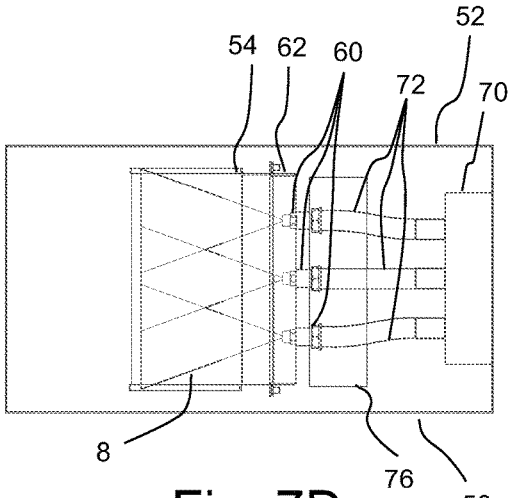
FIG. 7D illustrates a top, cutaway view of the filter media cleaning system showing spray jets from nozzles thereof.
Figure 8A:
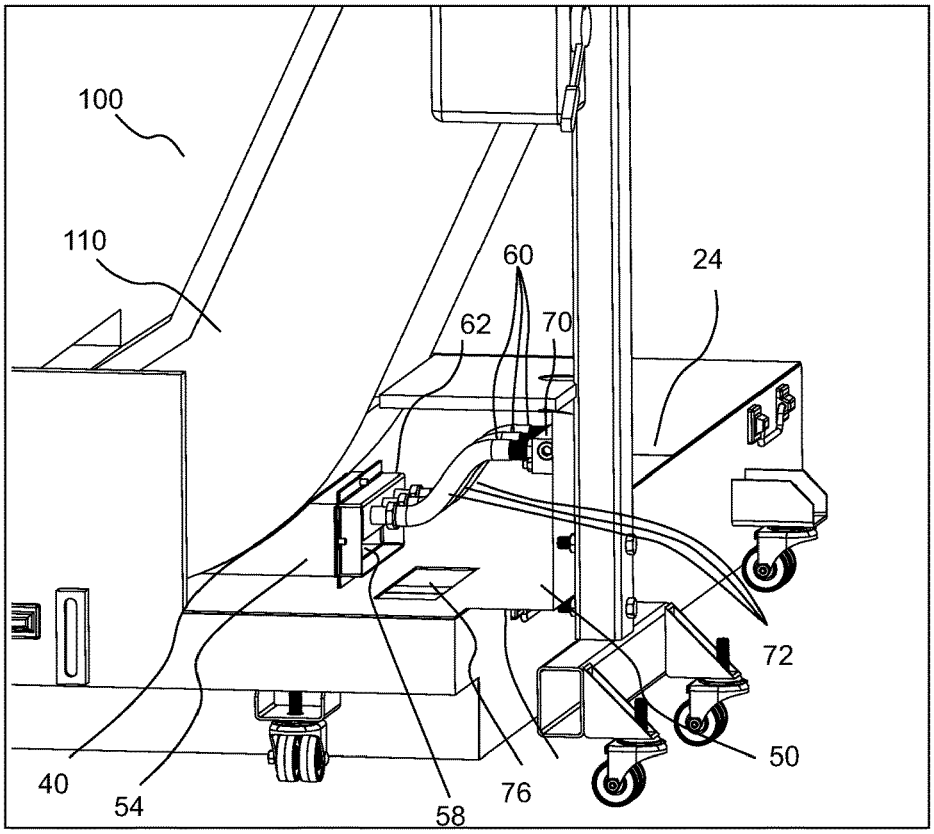
FIG. 8A illustrates a perspective view of a portion of the system of FIG. 1A with a number of housing sections and the conveyor belt or track removed to illustrate the filter media cleaning system.
Figure 8B:
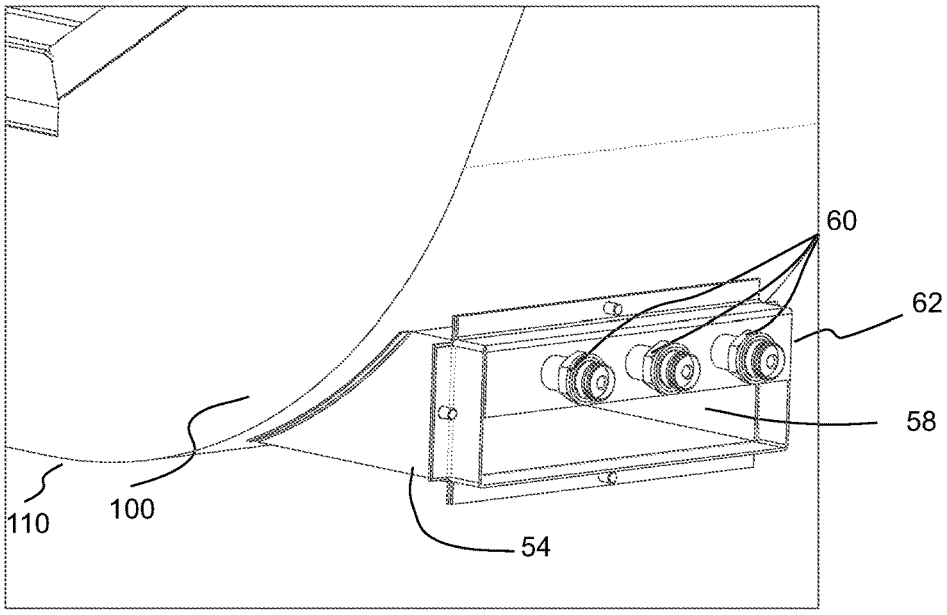
FIG. 8B illustrates a perspective view of the fluid/liquid outlet from of the filter medial cleaning system in operative connection with the conveyor system housing.

A filter media cleaning system 50 hereof is placed in fluid connection with the second side of screen 40. In that regard, screen 40 is place in connection with an arced opening 56 in a flow channel or conduit 54 within a housing 52 of filter media cleaning system 50 (see, for example, FIGS. 3C and 7B). Filter media cleaning system 50 includes a high pressure nozzle or a plurality of nozzles 60 mounted upon the nozzle mounting plate 62. The number of nozzles 60 is, for example, dependent on the area of screen 40 that is required for the coolant flow of the particular metal cutting machine 200. High pressure nozzles 60 may, for example, be connected to an intermediate distribution manifold 70 via high-pressure hosing 72 or may simply plumbed directly with a high pressure hose 310 to the dump valve 320 of a high pressure coolant system 300. In the illustrated embodiment, nozzle mounting plate 62 is attached to flow channel or conduit 54. Flow channel or conduit 54 includes opening 56 on a first end thereof and an outlet 58 on a second end thereof via which liquid passing from first section 22, through screen 40 and into flow channel or conduit 56 may pass into second section 24 via a conduit 76 (see, for example, FIG. 7B).

The particles or particulate 5 (see FIG. 7A) to be separated from the coolant liquid are collected on screen 40 in the normal flow of coolant from first section 22 of tank 20 to second section 24 of tank 20. When a state change occurs in high pressure coolant system 300, and dump valve 320 opens, particulate 5 is forcefully removed by a high pressure coolant spray 8 (see, for example, FIGS. 7A through 7D) emanating from cleaning nozzles 60, which blasts particulate 5 off of filter screen(s) 40 and back into coolant in firs section (dirty side) 22 of tank 20. Nozzles 60 may, for example, spray filter screen 40 at a pressure that, for example, may begin at 1000 psi to 3000 psi and decline to 0 psi over a period of, for example, 2 seconds (see, for example, the examples below). The removal of particulate 5 from screen(s) 40, for example, prevents clogged screens, conveyor flooding and insufficient flow to pumps of high pressure coolant system 300.

Conveyor track or belt 120 of conveyer system 100 may, for example, be designed to collect the particulate removed from screen 40 via wipers 122 within conveyer enclosure or housing 110 that approximately matches the path of the wipers so that particulate 5 (along with other particles and chips from machine tool 200 is collected and conveyed to a chip hopper 150 (see FIG. 1A). In a number of embodiments, wipers 122 were formed from a KEVLAR® reinforced material. KEVLAR is an aramid fiber available from DuPont of Wilmington, Del. In a number of embodiments, wipers 122 do not contact screen 40 as wipers 122 pass thereby.

Coolant liquid from first section 22 of tank 20 is substantially completely filtered via screen(s) 40 before entering second section 24 of tank 20. In the illustrated embodiment, coolant liquid from first section 22 must pass through screen 40 and conduit 58 (which is the only flow path from conveyor system 100 and first section 22 of tank 20 to second section 24) to enter second section 24. Because the coolant entering second section 24 is substantially completely filtered, virtually no particulate chips get into second section 24. Low coolant alarms and other machine fault conditions are essentially eliminated and material change-over times are improve as compared to currently available systems. Furthermore, damage to the pumps of high-pressure coolant system 300 by chips and/or contamination is reduced or prevented. Contamination that may be introduced into machine tool 200 via unfiltered pumps (which can cause damage to all machine tool components) is reduced or prevented. Moreover, there is no need to manually clean conveyor system 100, for example, when material change occurs.

EXAMPLES

Example 1—Small Part with 24-Hour Operation

The part being manufactured is a high pressure fitting. The total cycle time is 2.5 minutes, including part change. The number of tools used is 11. 2.5 minutes/11 tool changes results in 4.4 tool changes per minute. In a 24-hour day there are 1,440 minutes (24 hours per day×60 minutes per hour=1440 minutes per day). There are thus 6336 possible tool changes per day (1440 minutes per day×4.4 tool changes per minute=6336 possible tool changes per day). In the case of 80% efficiency, there will be 5068 blast of high pressure coolant from nozzles 60 per day (6336 possible tool changes per day×80% efficiency=5068 blasts of high pressure coolant per day). The coolant system motor decelerates from 5 kw to zero in 2 seconds, so the average energy released is 2.5 kw for 2 seconds. There will be 2.81 hours of coolant fluid blasts each day (5068 blasts of high pressure coolant per day×2=10,136 seconds of "dump" or 2.81 hours) 11.7% (2.81/24) of the high pressure coolant system energy use will be redirected to clean the filter screens 60. 5000 watts (5 kw)×2.81 hours=14,050 watts.

Example 2—Larger Part with 24-Hour Operation

The part in this example is a ring used as the top of a filter vessel. The total cycle time is 6.5 minutes including part change. The number of tools used is 10. Thus, there will be 0.65 tool changes per minute (6.5 minutes/10 tool changes=0.65 tool changes per minute). There will be 936 possible tool changes per day (1440 minutes per day×0.65 tool changes per minute=936 possible tool changes per day). At 80% efficiency, there will be 748 blasts of high pressure coolant from nozzles 60 per day (936 possible tool changes per day×80% efficiency=748 blasts of high pressure coolant per day). As described above, the coolant system motor decelerates from 5 kw to zero in 2 seconds so the average energy released is 2.5 kw for 2 seconds. There will be 0.415 hours of coolant fluid blasts each day (748 blasts of high pressure coolant per day×2=1496 seconds of "dump" or 0.415 hours). 1.7% (0.415/24) of the high pressure coolant system energy use will be redirected to clean filter screens 60. 5000 watts (5 kw)×0.415 hours=2075 watts.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A system comprising:

a high-pressure coolant system for supplying coolant to a machine tool under pressure, the high-pressure coolant system comprising a pump in fluid connection with at least one outlet via a first valve to provide high-pressure coolant to the machine tool and in fluid connection with a dump valve to relieve pressure upon a state change of the high-pressure coolant system in which supply of a high-pressure liquid from the high-pressure coolant system to the machine tool is stopped by closing the first valve;

at least one nozzle plumbed to the dump valve; and at least one filter element, the at least one nozzle being configured to spray the at least one filter element with the high-pressure liquid from the high-pressure coolant system upon actuation of the dump valve upon the state change of the high-pressure coolant system.

2. The system of claim 1 wherein the at least one nozzle is configured to spray the at least one filter element to remove metal particles therefrom.

3. The system of claim 2 further comprising a conveyor system to be placed in operative connection with the machine tool to convey metal particles from the machine tool to a collection volume, the conveyor system being placed in fluid connection with a first tank section for collecting coolant supplied to the machine tool and metal particles.

4. The system of claim 3 wherein the at least one filter element separates the first tank section from a second tank section for the coolant, the second tank section being in fluid connection with the high-pressure coolant system.

5. The system of claim 4 wherein the at least one filter element is a screen.

6. The system of claim 5 wherein the at least one filter element is placed in connection with an opening in a housing of the conveyor system.

7. The system of claim 5 wherein the screen is configured to prevent particles of a size no greater than 500 microns from passing therethrough.

8. The system of claim 5 wherein the screen is configured to prevent particles of a size no greater than 250 microns from passing therethrough.

9. The system of claim 5 wherein the screen is configured to prevent particles of a size no greater than 100 microns from passing therethrough.

10. The system of claim 6 wherein the conveyor system comprises a plurality of wipers to collect metal particles removed from the screen via spray from the nozzle.

11. A system comprising:

a high-pressure coolant system comprising a pump in fluid connection with at least one outlet via a first valve to provide high-pressure coolant to a machine tool and in fluid connection with a dump valve to relieve pressure upon a state change of the high-pressure coolant system in which supply of a high-pressure liquid from the high-pressure coolant system to the machine tool is stopped upon closing the first valve;

a first tank section for collecting coolant supplied to the machine tool from the high-pressure coolant system and metal particles;

a conveyor configured to be placed in operative connection with the machine tool to convey metal particles from the machine tool to a collection volume, the conveyor being placed in fluid connection with the first tank section;

a second tank section in fluid connection with the high-pressure coolant system;

at least one filter element separating the first tank section from the second tank section; and at least one nozzle plumbed to the dump valve via hosing wherein the at least one nozzle sprays the at least one filter element with the high-pressure liquid from the high-pressure coolant system upon actuation of the dump valve upon the state change of the high-pressure coolant system.

12. The system of claim 11 wherein the at least one filter element is placed in connection with an opening in a housing of the conveyor system.

13. The system of claim 11 wherein the at least one filter element is a screen.

14. The system of claim 13 wherein the screen is configured to prevent particles of a size no greater than 500 microns from passing therethrough.

15. The system of claim 13 wherein the screen is configured to prevent particles of a size no greater than 250 microns from passing therethrough.

16. The system of claim 13 wherein the screen is configured to prevent particles of a size no greater than 100 microns from passing therethrough.

17. The system of claim 14 wherein the conveyor comprises a plurality of wipers to collect metal particles removed from the screen via spray from the at least one nozzle.

* * * * *